US011331694B2

(12) United States Patent
Liu et al.

(10) Patent No.: US 11,331,694 B2
(45) Date of Patent: May 17, 2022

(54) PARCEL SUPPLY METHOD AND APPARATUS, ELECTRONIC DEVICE, AND STORAGE MEDIUM

(71) Applicant: Beijing Jingdong Zhenshi Information Technology Co., Ltd., Beijing (CN)

(72) Inventors: Min Liu, Beijing (CN); Genyun Zhang, Beijing (CN)

(73) Assignee: Beijing Jingdong Zhenshi Information Technology Co., Ltd., Beijing (CN)

( * ) Notice: Subject to any disclaimer, the term of this patent is extended or adjusted under 35 U.S.C. 154(b) by 171 days.

(21) Appl. No.: 16/652,684

(22) PCT Filed: Sep. 20, 2018

(86) PCT No.: PCT/CN2018/106756
§ 371 (c)(1),
(2) Date: Apr. 1, 2020

(87) PCT Pub. No.: WO2019/080678
PCT Pub. Date: May 2, 2019

(65) Prior Publication Data

US 2020/0246838 A1 Aug. 6, 2020

(30) Foreign Application Priority Data

Oct. 27, 2017 (CN) ..... 201711020534.0

(51) Int. Cl.
*B07C 3/08* (2006.01)
*B07C 3/14* (2006.01)

(52) U.S. Cl.
CPC ..... *B07C 3/08* (2013.01); *B07C 3/14* (2013.01); *B07C 2501/0063* (2013.01)

(58) Field of Classification Search
CPC ..... B07C 3/08; B07C 3/14; B07C 2501/0063; B07C 3/12; B07C 3/18
See application file for complete search history.

(56) References Cited

U.S. PATENT DOCUMENTS 4,832,204 A 5/1989 Handy et al.
9,333,649 B1 * 5/2016 Bradski ..... G06T 7/529
(Continued)

FOREIGN PATENT DOCUMENTS

CN 1288399 A 3/2001
CN 104209278 A 12/2014
(Continued)

OTHER PUBLICATIONS

The CN2OA issued Jan. 6, 2021 by the CNIPA.
(Continued)

*Primary Examiner* — Patrick H Mackey
(74) *Attorney, Agent, or Firm* — Qinghong Xu

(57) ABSTRACT

A parcel supply method and apparatus, an electronic device and a storage medium, which relate to the technical field of automation. The method comprises: recognizing information about a parcel on a transport belt (S110); obtaining state information about transport vehicles used for transporting the parcel (S120); according to the information about the parcel, the state information about the transport vehicles and state information of a mechanical arm used for grasping the parcel, determining a dispatch task for grasping and placing the parcel (S130); and dispatching, according to the dispatch task, the mechanical arm to grasp the parcel and place the parcel on a corresponding transport vehicle, so that the transport vehicle transports the parcel (S140). In the method, it can be ensured that a parcel is accurately grasped and placed, and accordingly, it can be ensured that automatic parcel supply can be implemented.

16 Claims, 5 Drawing Sheets

(56) References Cited

U.S. PATENT DOCUMENTS

| | | | | |
|---|---|---|---|---|
| 10,793,375 | B2 * | 10/2020 | Wagner | G05B 19/4189 |
| 10,906,188 | B1 * | 2/2021 | Sun | B07C 5/36 |
| 2014/0032034 | A1 | 1/2014 | Raptopoulos et al. | |
| 2014/0180479 | A1 * | 6/2014 | Argue | B25J 9/0093 700/259 |
| 2018/0118462 | A1 * | 5/2018 | Zevenbergen | G06Q 10/087 |
| 2018/0200761 | A1 * | 7/2018 | Putcha | G06Q 50/28 |

FOREIGN PATENT DOCUMENTS

| | | | |
|---|---|---|---|
| CN | 104525488 | A | 4/2015 |
| CN | 104858150 | A | 8/2015 |
| CN | 204672572 | U | 9/2015 |
| CN | 105618383 | A | 6/2016 |
| CN | 105728328 | A | 7/2016 |
| CN | 105817422 | A | 8/2016 |
| CN | 205675779 | U | 11/2016 |
| CN | 206322193 | U | 7/2017 |
| CN | 107051889 | A | 8/2017 |
| CN | 107597600 | A | 1/2018 |
| EP | 2403781 | B1 | 8/2013 |
| KR | 20130002813 | A | 1/2013 |
| KR | 101282354 | B1 | 7/2013 |

OTHER PUBLICATIONS

The EESR issued Oct. 2, 2020 by the EPO.
The ISR issued Dec. 24, 2018 by the WIPO.
The CN1OA issued Mar. 12, 2020 by the CNIPA.

* cited by examiner

PARCEL SUPPLY METHOD AND APPARATUS, ELECTRONIC DEVICE, AND STORAGE MEDIUM

The present disclosure is an US national phase of International Application No. PCT/CN2018/106756, filed on Sep. 20, 2018, which claims priority to Chinese Patent Application No. 201711020534.0, filed Oct. 27, 2017, titled "Method and apparatus for supplying package, electronic device and storage medium", the entire content of which is incorporated herein by reference for all purpose.

TECHNICAL FIELD

The present disclosure relates to the field of automation technology and, more particularly, to a method for supplying a package, an apparatus for supplying a package, an electronic device, and a computer-readable storage medium.

BACKGROUND

With the rapid development of electronic commerce, the scale of the packages that the logistic express industry needs to transport every day is also increasing, and the demand for automatic sorting of packages is also increasing.

At present, in one technical solution, in order to realize automatic sorting of packages, robots are used to sort packages. However, in the existing robotic sorting system, before the packages are sorted, the packages need to be manually placed on a transport vehicle for supplying, and automatic supplying is not realized, which is inefficient.

Therefore, how to realize automatic supply of packages has become an urgent technical problem.

It should be noted that the information disclosed in the background section above is only used to enhance the understanding of the background of the present disclosure, and therefore may include information that does not constitute the prior art known to those of ordinary skill in the art.

SUMMARY

An object of the present disclosure is to provide a method for supplying a package, an apparatus for supplying a package, an electronic device, and a computer-readable storage medium, so as to at least to some extent overcome one or more of the problems caused by the limitations and defects of the related art.

According to a first aspect of the embodiments of the present disclosure, there is provided a method for supplying a package, including: recognizing information of a package on a conveyor belt; obtaining status information of a transport vehicle for transporting the package; determining a scheduling task for grasping and placing the package based on the information of the package, the status information of the transport vehicle, and status information of a robotic arm for grasping the package; and scheduling the robotic arm to grasp and place the package on a corresponding transport vehicle based on the scheduling task, so that the transport vehicle transports the package.

In some embodiments of the present disclosure, based on the above aspect, the determining the scheduling task for grasping and placing the package based on the information of the package, the status information of the transport vehicle, and the status information of the robotic arm for grasping the package includes: determining whether the package is a graspable package according to the information of the package; and when it is determined that the package is the graspable package, determining the scheduling task for grasping and placing the graspable package based on the status information of the transport vehicle and the status information of the robotic arm for grasping the package.

In some embodiments of the present disclosure, based on the above aspect, the method for supplying a package further includes: when it is determined that the package is not a graspable package, scheduling the robotic arm not to grasp the package.

In some embodiments of the present disclosure, based on the above aspect, the determining the scheduling task for grasping and placing the graspable package based on the status information of the transport vehicle and the status information of the robotic arm for grasping the package includes: determining the scheduling task for grasping and placing the graspable package based on the status information of the transport vehicle and the status information of the robotic arm for grasping the package by using a time optimal allocation method.

In some embodiments of the present disclosure, based on the above aspect, the determining whether the package is the graspable package according to the information of the package includes: determining whether the package has an abnormality according to the information of the package, wherein the abnormality includes one or more of the following: oversize, overheight, overweight, waybill not facing up, abnormal barcode, and abnormal package.

In some embodiments of the present disclosure, based on the above aspect, the recognizing the information of the package on the conveyor belt includes: recognizing at least one of the following information of the package by a camera: a package barcode, a package type, a package size, a package coordinate, and an orientation of a waybill on the package.

In some embodiments of the present disclosure, based on the above aspect, the recognizing the information of the package on the conveyor belt further includes: obtaining weight information of the package according to the information of the package recognized by the camera.

In some embodiments of the present disclosure, based on the above aspect, the obtaining the weight information of the package according to the information of the package recognized by the camera includes: sending the information of the package recognized by the camera to a designated system, and receiving the weight information of the package returned by the designated system.

In some embodiments of the present disclosure, based on the above aspect, the obtaining the status information of the transport vehicle for transporting the package includes: communicating with a system that manages the transport vehicle to obtain the status information of the transport vehicle for transporting the package.

In some embodiments of the present disclosure, based on the above aspect, after scheduling the robotic arm to grasp and place the package on the corresponding transport vehicle based on the scheduling task, sending information about completion of placing the package to the system that manages the transport vehicle, so that the system that manages the transport vehicle schedules the transport vehicle to transport the package.

In some embodiments of the present disclosure, based on the above aspect, the grasping the package by the robotic arm includes: dynamically rotating a gripper of the robotic arm to grasp the package according to the information of the package.

In some embodiments of the present disclosure, based on the above aspect, the recognizing the information of the package on the conveyor belt includes: recognizing the same batch of packages on the conveyor belt one or more times to obtain information of the batch of packages; or recognizing each package on the conveyor belt to obtain information of the package.

In some embodiments of the present disclosure, based on the above aspect, the method for supplying a package further includes: scheduling a number of the robotic arm to be turned on according to a number of the packages.

According to a second aspect of the embodiments of the present disclosure, there is provided an apparatus for supplying a package, including: a recognition unit, configured to recognizing information of a package on a conveyor belt; a status information obtaining unit, configured to obtain status information of a transport vehicle for transporting the package; a determining unit, configured to determine a scheduling task for grasping and placing the package based on the information of the package, the status information of the transport vehicle, and status information of a robotic arm for grasping the package; and a scheduling unit, configured to schedule the robotic arm to grasp and place the package on a corresponding transport vehicle based on the scheduling task, so that the transport vehicle transports the package.

According to a third aspect of the embodiments of the present disclosure, there is provided electronic device, including: a processor; and a memory, wherein the memory is stored with computer-readable instructions, and when the computer-readable instructions are executed by the processor, the method for supplying a package according to the above first aspect.

According to a fourth aspect of the embodiments of the present disclosure, there is provided computer-readable storage medium having stored thereon a computer program that, when executed by a processor, implements the method for supplying a package according to the above first aspect.

In the technical solutions provided by some embodiments of the present disclosure, the scheduling task for grasping and placing the package is determined based on the recognized information of the package, the status information of the transport vehicle, and the status information of the robotic arm, and the robotic arm is scheduled to grasp and place the package on the corresponding transport vehicle for transportation based on the scheduling task. On the one hand, the scheduling task for grasping and placing the package is determined based on the recognized information of the package, the status information of the transport vehicle, and the status information of the robotic arm, then the scheduling task can be comprehensively determined based on the package information, the status information of the robotic arm, and the status information of the transport vehicle, thereby ensuing accurate grasping and placement of the package. On the other hand, the robotic arm is scheduled to pick up the package and place it on the corresponding transport vehicle for transportation based on the scheduling task, making it possible to schedule the robotic arm based on the scheduling task to realize automatic supply of the package, which is conducive to the realization of a fully automated package sorting system.

It should be understood that the above general description and the following detailed description are merely exemplary and explanatory, and should not limit the present disclosure.

BRIEF DESCRIPTION OF THE DRAWINGS

The accompanying drawings, which are incorporated in and constitute a part of this specification, illustrate embodiments consistent with the present disclosure and, together with the description, serve to explain the principles of the present disclosure.

DETAILED DESCRIPTION

Figure 1:
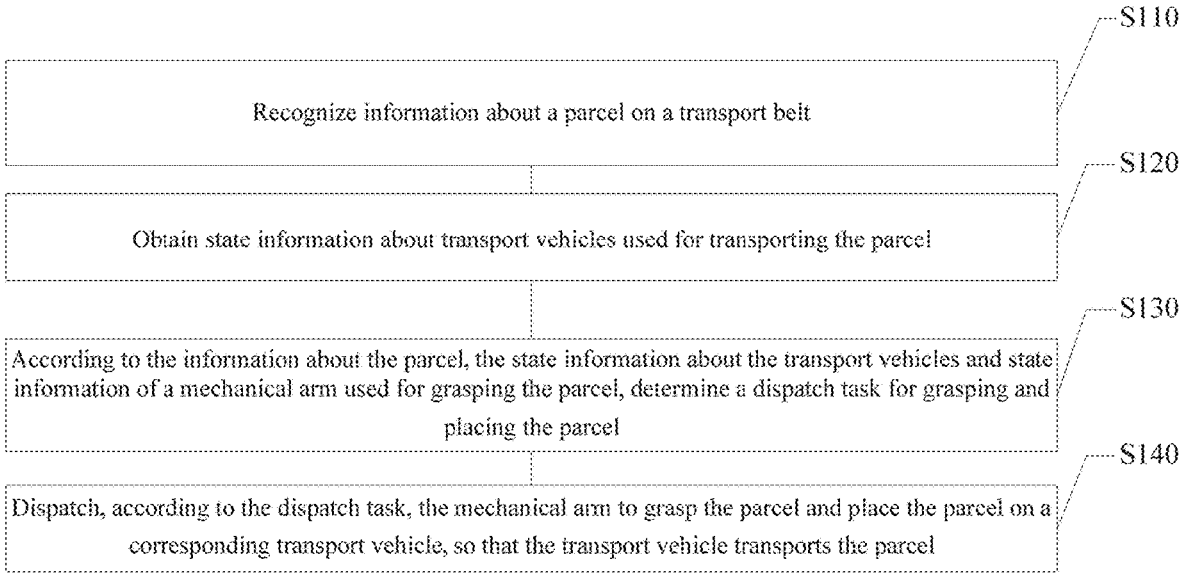
FIG. 1 is a schematic flowchart of a method for supplying a package according to an exemplary embodiment of the present disclosure.

The exemplary embodiments will now be described more fully with reference to the accompanying drawings. However, the exemplary embodiments can be implemented in various forms and should not be construed as limited to the examples set forth herein; rather, these embodiments are provided so that the present disclosure will be more comprehensive and complete, and the concepts of the exemplary embodiments will be fully conveyed to those skilled in the art. The described features, structures, or characteristics may be combined in one or more embodiments in any suitable manner. In the following description, numerous specific details are provided to give a thorough understanding of the embodiments of the present disclosure. However, those skilled in the art will realize that the technical solutions of the present disclosure may be practiced without one or more of the specific details, or other methods, components, devices, steps, etc. may be adopted. In other cases, well-known technical solutions are not shown or described in detail to avoid obscuring aspects of the present disclosure.

In addition, the drawings are merely schematic illustrations of the present disclosure and are not necessarily drawn to scale. The same reference numerals in the drawings represent the same or similar parts, and thus repeated descriptions thereof will be omitted. Some block diagrams shown in the drawings are functional entities and do not necessarily have to correspond to physically or logically independent entities. These functional entities may be implemented in the form of software, or implemented in one or more hardware modules or integrated circuits, or implemented in different networks and/or processor devices and/or microcontroller devices.

FIG. 1 is a flowchart of a method for supplying a package according to a first exemplary embodiment of the present disclosure. The method for supplying a package can be applied to a vision robotic arm system 420 shown in FIG. 4. Referring to FIG. 1, the method for supplying a package may include the following steps.

In step S110, information of a package on a conveyor belt is recognized.

In step S120, status information of a transport vehicle for transporting the package is obtained.

In step S130, a scheduling task for grasping and placing the package is determined based on the information of the package, the status information of the transport vehicle, and status information of a robotic arm for grasping the package.

In step S140, the robotic arm is scheduled to grasp the package and place it on a corresponding transport vehicle based on the scheduling task, so that the transport vehicle transports the package.

According to the method for supplying a package in this exemplary embodiment, on the one hand, the scheduling task for grasping and placing the package is determined based on the recognized package information, the status information of the transport vehicle, and the status information of the robotic arm, thus the scheduling task can be comprehensively determined based on the package information, the status information of the robotic arm and the status information of the transport vehicle, so as to ensure the accurate grasp and placement of the package. On the other hand, based on the scheduling task, the robotic arm is used to grasp the package and place it on the corresponding transport vehicle for transportation, thus it is possible to schedule the robotic arm to realize automatic supply based on the scheduling task, which is beneficial to the realization of a fully automated package sorting system.

In the following, the method for supplying a package in this exemplary embodiment will be described in detail with reference to the drawings.

Referring to FIG. 1, in step S110, information of a package on a conveyor belt is recognized.

Figure 2:
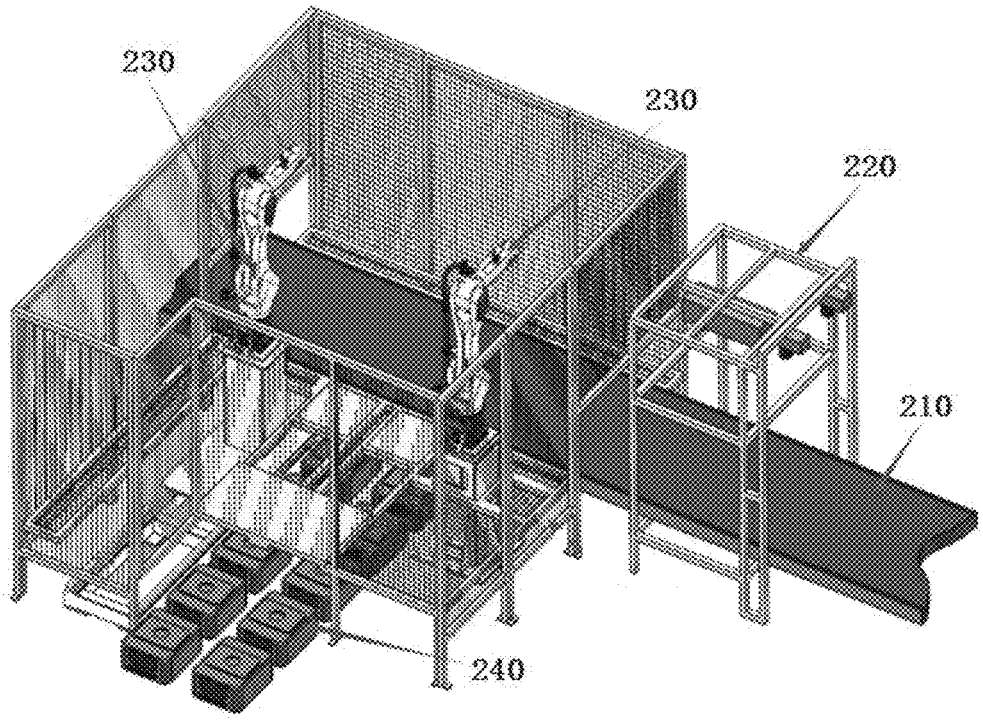
FIG. 2 is a schematic structural diagram of a vision robotic arm system according to an exemplary embodiment of the present disclosure.

FIG. 2 is a schematic structural diagram of a vision robotic arm system to which the method for supplying a package of the first exemplary embodiment of the present disclosure is applied. Referring to FIG. 2, in this exemplary embodiment, the information of the package on the conveyor belt 210 can be recognized by an image recognition unit installed on a front end bracket 220 of the robotic arm 230 in the vision robotic arm system shown in FIG. 2. For example, the information of the package on the conveyor belt 210 can be recognized by a camera. The information of the package may include at least one of the following information: a package barcode, a package type, a package size, package coordinates, and an orientation of a waybill on the package.

Figure 3:
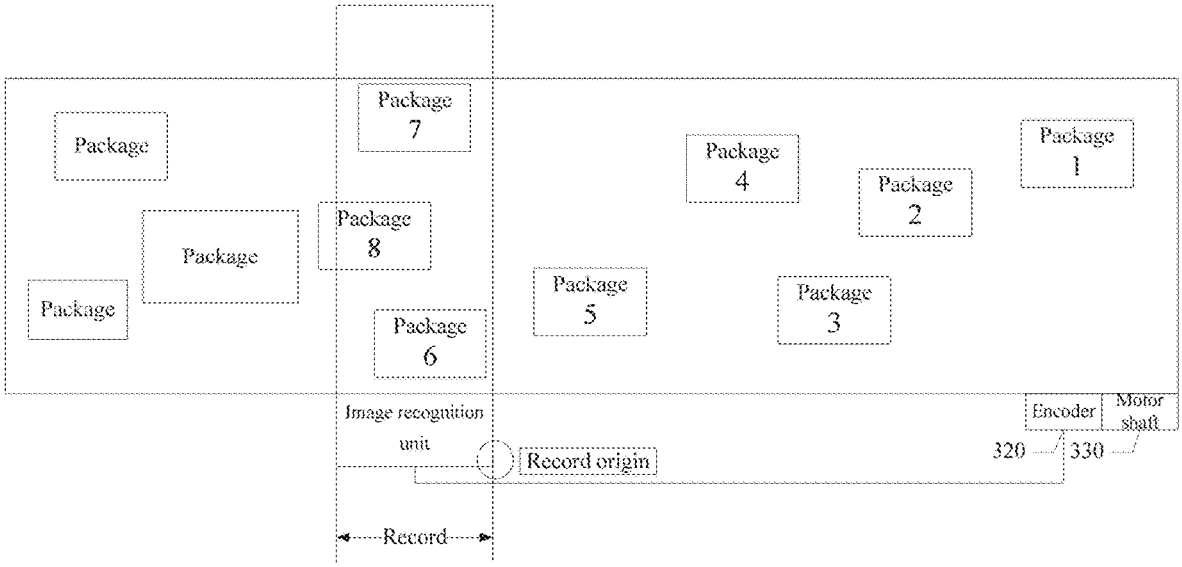
FIG. 3 is a schematic diagram showing a supply process of a package according to an exemplary embodiment of the present disclosure.

For example, referring to FIG. 3, it is assumed that the conveyor belt conveys the package through a motor shaft 330 at a speed of 0.4 m/s to 0.6 m/s, and the package is visually recognized by the image recognition unit before the package reaches the robotic arm. For example, a three-dimensional camera may be used to utilize a structured light to perform three-dimensional point cloud detection on the package, and the position, angle, size and other information of the package are calculated through a visual recognition system; a two-dimensional camera is used to recognize the barcode of the package and recognize position information of the barcode, and based on the position information of the barcode, the orientation of the waybill of the package may be determined. In addition, in this exemplary embodiment, the speed of the conveyor belt can be calculated by an encoder 320. For example, the encoder 320 may be provided at a motor or a roller shaft of the conveyor belt, etc., to convert the angular displacement into a pulse signal and send it out. The linear speed of the conveyor belt may be calculated through the number of the pulse signals.

Further, in this exemplary embodiment, the weight information of the package may also be obtained through a designated system according to the recognized package information. For example, referring to FIG. 4, the package information recognized by the vision robotic arm system 420 may be sent to a Distributed Control System (DCS) system 430. The DCS system 430 queries the weight information of the package from a database server 440, and returns the queried weight information of the package to the vision robotic arm system 420. In addition, each sub-unit in the entire package sorting system can also be viewed through a monitoring Kanban system 460 to be able to grasp the information of each link in the entire package supply and sorting process at any time.

Next, referring to FIG. 1, in step S120, status information of a transport vehicle for transporting a package is obtained.

Figure 4:
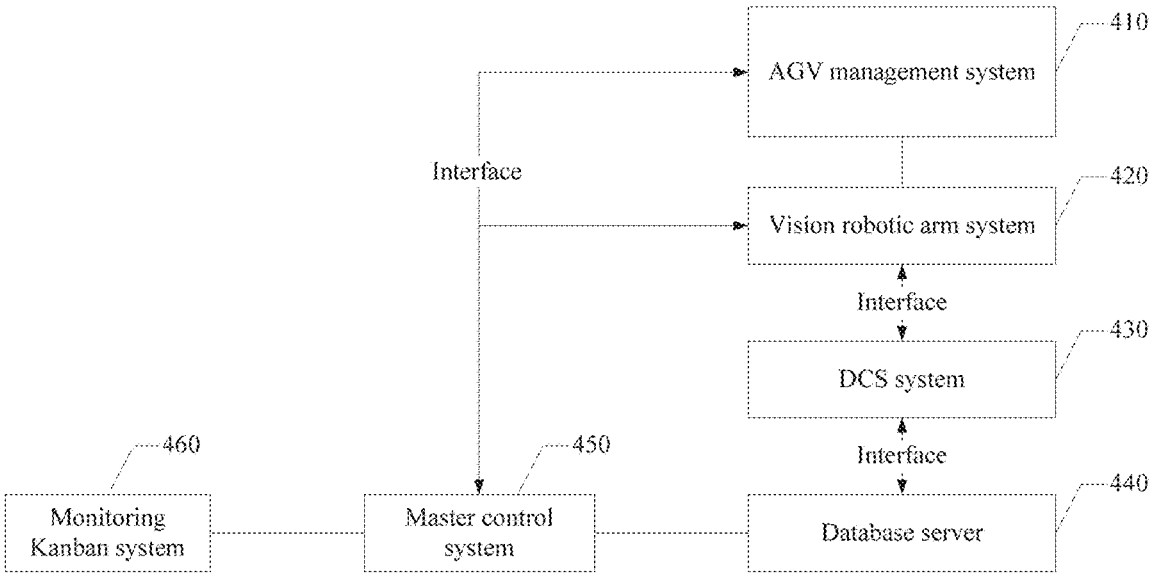
FIG. 4 is a schematic diagram showing a relationship between various systems of a package sorting process according to an exemplary embodiment of the present disclosure.

In this exemplary embodiment, the transport vehicle may be an Automated Guided Vehicle (AGV) trolley, such as the AGV vehicle 240 in FIG. 2. Referring to FIG. 4, the vision robotic arm system 420 may communicate with the AGV management system 410 to obtain the status information of the transport vehicle for transporting packages.

For example, the vision robotic arm system 420 may send a request to the AGV management system 420 to obtain the status information of the transport vehicle, and receive the status information of the transport vehicle for transporting the package returned from the AGV management system 410. It should be noted that, in this exemplary embodiment, the status information of the transport vehicle may include status information such as deactivation, normal operation, request, rejection, already in place, departure, completion of tasks, and abnormality.

In addition, in the present exemplary embodiment, the vision robotic arm system 420 may send the recognized package barcode of the package to the AGV management system 410. In addition, the vision robotic arm system 420 may also send status information of each robotic arm to the AGV management system 410. The status information of the robotic arm may also include status information such as deactivation, normal operation, request, rejection, completion of tasks, and abnormality.

Next, referring to FIG. 1, in step S130, based on the information of the package, the status information of the transport vehicle, and the status information of the robotic arm for grasping the package, a scheduling task for grasping and placing the package is determined.

In this exemplary embodiment, the number of packages to be supplied may be determined according to the recognized package information, and the number of the robotic arm to be turned on may be scheduled according to the number of packages to be supplied. For example, referring to FIG. 4, after recognizing the package information, the vision robotic arm system 420 may send the recognized package information to a master control system 450. The master control system 450 calls an interface of the vision robotic arm system 420 to control turning-on of the vision robotic arm system 420, and realizes the scheduling of the number of the robotic arm to be turned on according to the number of packages. In other embodiments of the present disclosure, the user may also directly input the number of packages to be supplied based on the interface of the master control system 450, and then the master control system 450 can realize the scheduling of the number of robotic arms to be turned on according to the number of packages.

Further, whether the package is a graspable package may be determined according to the package information. When the package is determined to be a graspable package, the scheduling task for grasping and placing the package is determined based on the status information of the transport vehicle and the status information of the robotic arm for grasping the package. For example, it can be determined whether there is an abnormality in the package based on the information of the package. When it is determined that there is no abnormality in the package, it is determined that the package is a graspable package. The abnormality includes one or more of the following: oversize, overheight, overweight, waybill not facing up, abnormal barcode, and abnormal package. Although the above-mentioned package abnormalities are shown, the package abnormality in this exemplary embodiment is not limited thereto. For example, there may also be abnormal circumstances such as being unable to grasp, package rule verification, and waybill barcode less than 14 digits.

In addition, in this exemplary embodiment, when it is determined that the package is not graspable, the robotic arm may be scheduled to not grasp the package. For example, when the package is overweight (for example, more than 5 kg and does not include 5 kg), the package regular rule check, such as the barcode rule check fails, or when there are other abnormalities, the package that cannot be grasped is leaved for manual processing. In this exemplary embodiment, the interface of the DCS system 430 and the interface of the master control system 450 shown in FIG. 4 can also be called to upload the package size and other information to the database server 440.

Further, in this exemplary embodiment, when it is determined that the package can be grasped, one or more scheduling methods may be used to determine the scheduling task for grasping and placing the graspable package based on the status information of the transport vehicle and the status information of the robotic arm for grasping the package. For example, under the control of the master control system 450, the vision robotic arm system 420 shown in FIG. 4 obtains the recognition result, automatically determines which packages are valid for grasping, automatically schedules the robotic arm with the grasping conditions, and assigns the grasping task for each robotic arm through a grasp rule of the package position (inside package has the priority) and the package height (high package has the priority). The scheduling method may be an optimal time allocation method to ensure that the waiting time of all robots, such as the robotic arm, is the shortest, which can also ensure the maximum grasp rate of the robotic arm.

Next, in step S140, the robotic arm is scheduled to grasp the package and place it on a corresponding transport vehicle based on the scheduling task, so that the transport vehicle transports the package.

In order to be able to grasp and place different packages, in this example embodiment, the angle of the robotic arm can be dynamically rotated to grasp the package according to the package information. For example, a 6-axis robotic arm and a vacuum suction gripper can be used to dynamically grasp and place the package. Referring to FIG. 2, after receiving the scheduling task, the robotic arm 230 may dynamically rotate the gripper according to the difference in the outer packaging of the package and the size of the package so as to adaptively grasp the package. After the robotic arm 230 successfully grasps the package, the information, such as whether the transport vehicle 240 is in place or whether goods can be placed on the automatic supply line, is verified. When the information is verified successfully, i.e., the transport vehicle is in place or goods can be placed on the automatic supply line, the package is placed on the corresponding transport vehicle 240.

Further, in this exemplary embodiment, after determining that the transport vehicle is in place or a supply window of the automatic supply line is in place, the package may be placed on the transport vehicle according to a certain height/center coincidence/length-width parallel rule. After the robotic arm is scheduled based on the scheduling task to grasp the package and place it on the corresponding transport vehicle, the information of completion of package placement may be sent to the AGV management system 410, so that the AGV management system 410 schedules the transport vehicle to transport the package.

After performing the grasping task, the interface of the DCS system 430 and the interface of the master control system 450 may be called to upload data of the grasp result to the DCS system 430 and the master control system 450. After the placement task is performed, the interface of the DCS system 430 and the interface of the master control system 450 may be called to upload data of placement result to the DCS system 430 and the master control system 450. After successful placement, the successful placement information may be sent to a downstream automatic sorting information system.

In addition, in this exemplary embodiment, referring to FIG. 4, the AGV management system 410 may perform information interaction with the vision robotic arm system 420 and perform tasks according to the status information of the robotic arm and the status information of the transport vehicle. When the transport vehicle arrives at a receiving station, the AGV management system 410 calls the interface of the vision robotic arm system 420 to notify the vision robotic arm system 420 that the goods are ready to be received.

It should be noted that, in this exemplary embodiment, recognizing the information of the package on the conveyor belt may include: recognizing the same batch of packages on the conveyor belt one or more times to obtain the information of the batch of packages; or recognizing each package on the conveyor belt to obtain information of the package. In other words, for a batch of packages of the same specification, it can be recognized only one or more times, and it is not necessary to recognize the same packages so as to improve the efficiency of the package supply. For packages of different specifications, each package may be recognized.

Figure 5:
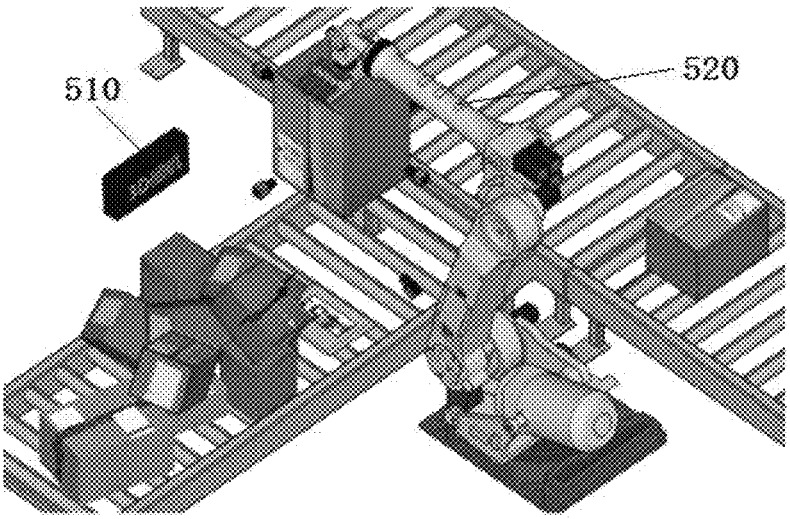
FIG. 5 is a schematic structural diagram of a vision robotic arm system according to an exemplary embodiment of the present disclosure.

FIG. 5 shows a schematic structural diagram of a vision robotic arm system according to a second exemplary embodiment to which the present disclosure is applied. Referring to FIG. 5, the same batch of static packages can be scanned once by the image recognition unit 510 of the vision robotic arm system 520, and multiple one-by-one grasping can be achieved by the robotic arm. When the shape of the batch of packages change during the grasping, the visual scanning is performed again, and then the grasping is performed again, and the successfully grasped package is placed in the designated position.

Figure 6:
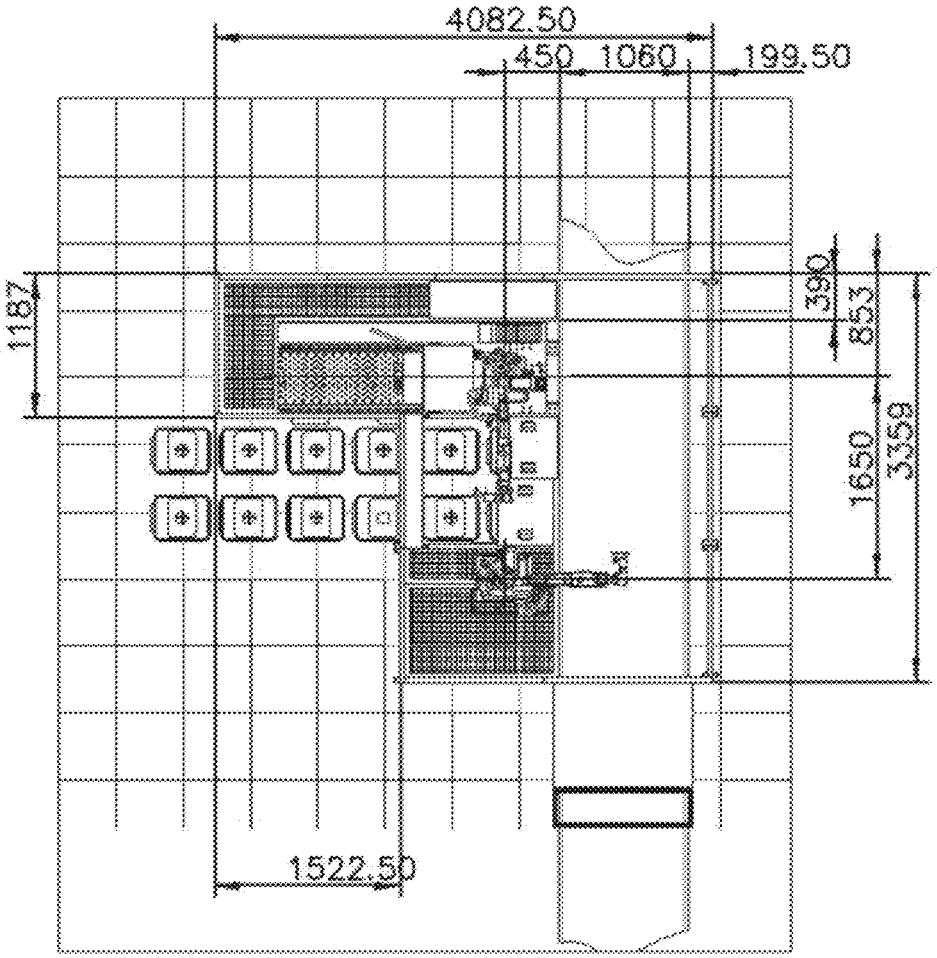
FIG. 6 is a plan view showing a schematic structure of a system for supplying a package according to an exemplary embodiment of the present disclosure.
Figure 7:
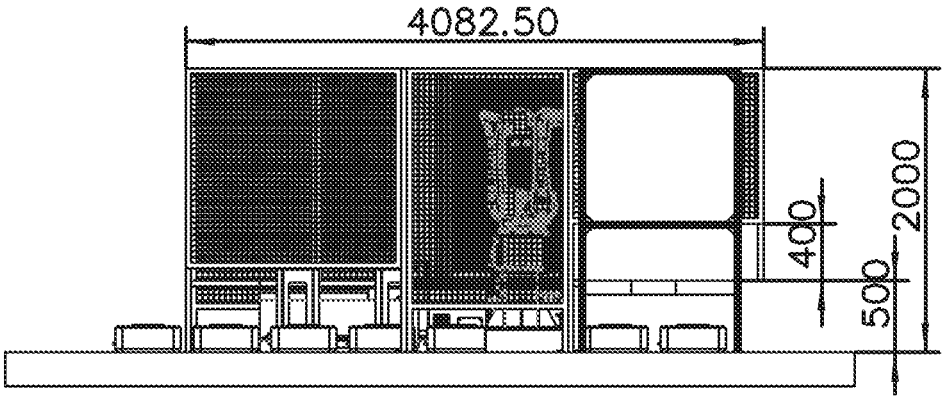
FIG. 7 is a side view of a schematic structure of a system for supplying a package according to an exemplary embodiment of the present disclosure.

In addition, in this exemplary embodiment, in order to ensure the accuracy of the recognized information during the operation and the security between the device operations, the positional relationship between the units of the system needs to be set. FIGS. 6 and 7 respectively show a top view and a side view of a schematic structure of a system for supplying a package according to an exemplary embodiment of the present disclosure. Referring to FIGS. 6 and 7, the positional relationship between the units of the system for supplying a package is as follows: the distance between the 2D recognition unit in the image recognition unit and the nearest robotic arm is 2067 mm, and the distance between the 3D recognition unit and the center of the nearest robotic arm is 1340 mm; the distance between the robotic arms is 1650 mm; the width of guard rails of a group of robotic arms is 3359 mm; the remaining detailed positional relationships are shown in FIGS. 6 and 7. The layout relationship between the units of the system for supplying a package is as follows: there are two rows of sorting AGV trolleys between the robotic arms, the distance between the center of the robotic arm and the sorting AGV trolley is about 1197 mm; and the distance between the robotic arms is 1100 mm.

Figure 8:
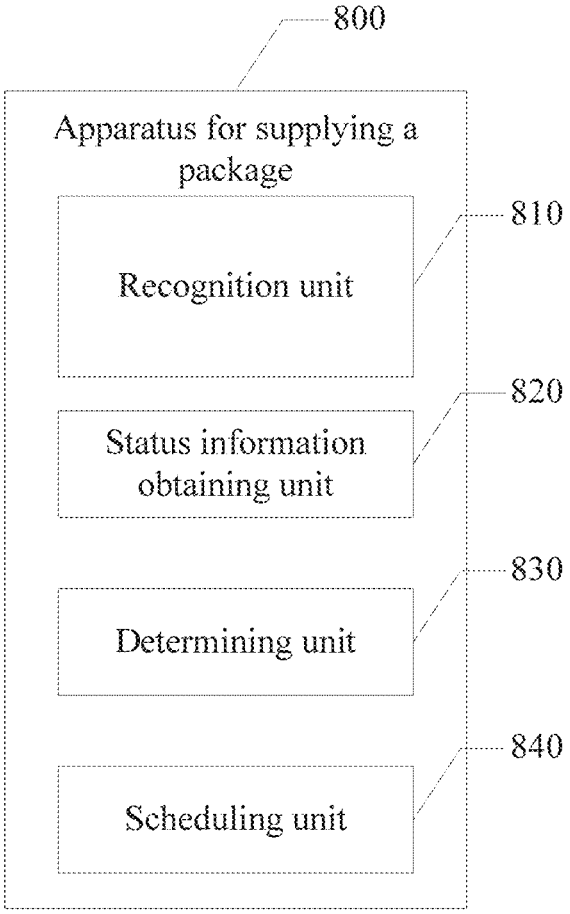
FIG. 8 is a schematic block diagram of an apparatus for supplying package according to an exemplary embodiment of the present disclosure.

In addition, in the embodiments of the present disclosure, an apparatus for supplying a package is also provided. As shown in FIG. 8, the apparatus for supplying a package 800 may include: a recognition unit 810, a status information obtaining unit 820, a determining unit 830, and a scheduling unit 840. The recognition unit 810 is configured to recognize information of a package on a conveyor belt; the status information obtaining unit 820 is configured to obtain status information of a transport vehicle for transporting the package; the determining unit 830 is configured to determine a scheduling task for grasping and placing the package based on the information of the package, the status information of the transport vehicle, and status information of a robotic arm for grasping the package; and the scheduling unit 840 is configured to schedule the robotic arm to grasp and place the package on a corresponding transport vehicle based on the scheduling task, so that the transport vehicle transports the package.

In some embodiments of the present disclosure, based on the foregoing solution, the determining unit 830 is configured to determine whether the package is a graspable package according to the information of the package; when determining that the package is the graspable package, determine the scheduling task for grasping and placing the graspable package based on the status information of the transport vehicle and the status information of the robotic arm for grasping the package.

In some embodiments of the present disclosure, based on the foregoing solution, the scheduling unit 840 is configured to, when it is determined that the package is a non-graspable package, schedule the robotic arm not to grasp the package.

In some embodiments of the present disclosure, based on the foregoing solution, the determining unit 830 is configured to determine the scheduling task for grasping and placing the graspable package based on the status information of the transport vehicle and the status information of the robotic arm for grasping the package by using a time optimal allocation method.

In some embodiments of the present disclosure, based on the foregoing solution, the determining unit 830 includes: an abnormality determining unit, configured to determine whether the package has an abnormality according to the information of the package, where the abnormality includes one or more of the following: oversize, overheight, overweight, waybill not facing up, abnormal barcode, and abnormal package.

In some embodiments of the present disclosure, based on the foregoing solution, the recognition unit 810 is configured to recognize at least one of the following information of the package by a camera: a package barcode, a package type, a package size, a package coordinate, and an orientation of a waybill on the package.

In some embodiments of the present disclosure, based on the foregoing solution, the recognition unit 810 is configured to obtain weight information of the package according to the information of the package recognized by the camera.

In some embodiments of the present disclosure, based on the foregoing solution, the recognition unit 810 includes: a communication unit, configured to send information of the package recognized by the camera to a designated system, and receive the weight information of the package returned by the designated system.

In some embodiments of the present disclosure, based on the foregoing solution, the status information obtaining unit 820 is configured to communicate with a system that manages the transport vehicle to obtain the status information of the transport vehicle for transporting the package.

In some embodiments of the present disclosure, based on the foregoing solution, after scheduling the robotic arm to grasp and place the package on the corresponding transport vehicle based on the scheduling task, send information about completion of placing the package to the system that manages the transport vehicle, so that the system that manages the transport vehicle schedules the transport vehicle to transport the package.

In some embodiments of the present disclosure, based on the foregoing solution, the scheduling unit 840 is configured to dynamically rotate a gripper of the robotic arm to grasp the package according to the information of the package.

In some embodiments of the present disclosure, based on the foregoing solution, the recognition unit 810 is configured to recognize the same batch of packages on the conveyor belt one or more times to obtain information of the batch of packages; or recognize each package on the conveyor belt to obtain information of the package.

In some embodiments of the present disclosure, based on the foregoing solutions, the apparatus 800 for supplying a package further includes: a robotic arm turning-on unit, configured to schedule the number of robotic arms to be turned on according to the number of packages.

Since each functional module of the apparatus 800 for supplying a package according to the exemplary embodiment of the present disclosure corresponds to the steps of the exemplary embodiment of the method for supplying a package described above, details are not described herein again.

In an exemplary embodiment of the present disclosure, an electronic device capable of implementing the above method is also provided.

Figure 9:
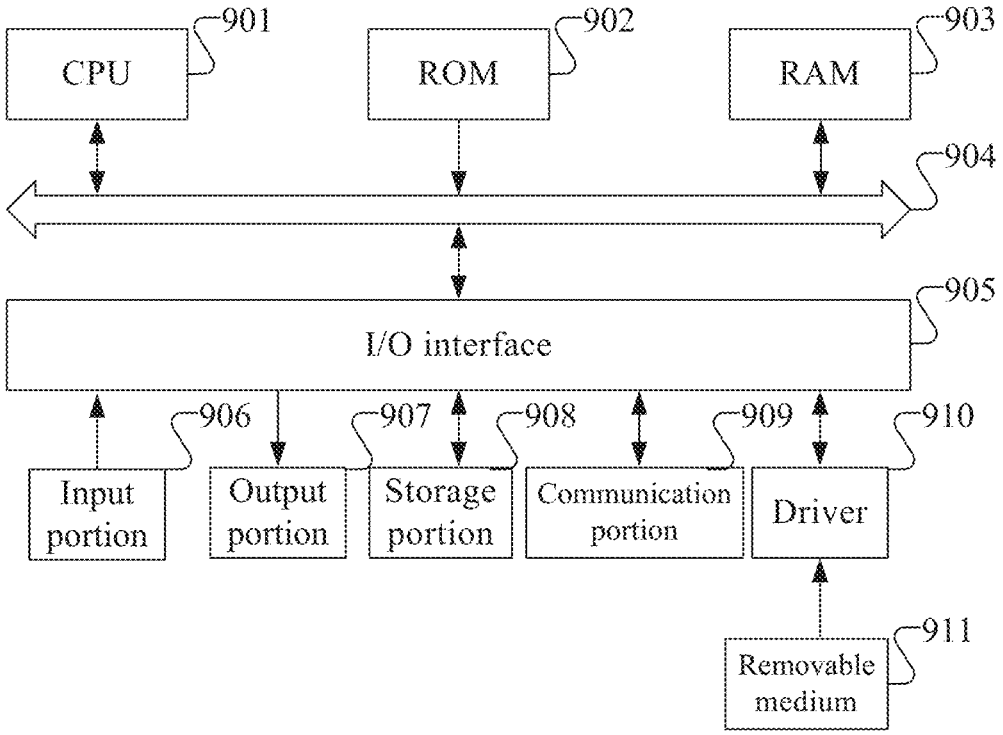
FIG. 9 is a schematic structural diagram of a computer system suitable for implementing an electronic device according to an embodiment of the present disclosure.

Reference is now made to FIG. 9, which illustrates a schematic structural diagram of a computer system 900 suitable for implementing an electronic device according to an embodiment of the present disclosure. The computer system 900 of the electronic device shown in FIG. 9 is only an example, and should not impose any limitation on the functions and scope of use of the embodiments of the present disclosure.

As shown in FIG. 9, the computer system 900 includes a central processing unit (CPU) 901, which can perform various appropriate actions and processes according to the program stored in the read-only memory (ROM) 902 or the program loaded into the random access memory (RAM) 903 from the storage portion 908. In the RAM 903, various programs and data required for system operation are also stored. The CPU 901, the ROM 902, and the RAM 903 are connected to each other through a bus 904. An input/output (I/O) interface 905 is also connected to the bus 904.

The following components are connected to the I/O interface 905: an input portion 906 including a keyboard, a mouse, and the like; an output portion 907 including a cathode ray tube (CRT), a liquid crystal display (LCD), and a speaker; a storage portion 908 including a hard disk and the like; and a communication portion 909 including a network interface card such as a LAN card, a modem, and the like. The communication portion 909 performs communication processing via a network such as the Internet. The driver 910 is also connected to the I/O interface 905 as needed. A removable medium 911, such as a magnetic disk, an optical disk, a magneto-optical disk, a semiconductor memory, etc., is installed on the driver 910 as needed, so that a computer program read therefrom is installed into the storage portion 908 as needed.

In particular, according to an embodiment of the present disclosure, the process described above with reference to the flowchart may be implemented as a computer software program. For example, the embodiments of the present disclosure include a computer program product including a computer program carried on a computer-readable medium, the computer program containing program code for performing the method shown in the flowchart. In such an embodiment, the computer program may be downloaded and installed from a network through the communication portion 909, and/or installed from a removable medium 911. When this computer program is executed by a central processing unit (CPU) 901, the above-mentioned functions defined in the system of the present application are executed.

It should be noted that the computer-readable medium shown in the present disclosure may be a computer-readable signal medium or a computer-readable storage medium or any combination of the foregoing two mediums. The computer-readable storage medium may be, for example, but not limited to, an electronic, magnetic, optical, electromagnetic, infrared, or semiconductor system, apparatus, or device, or any combination thereof. More specific examples of the computer-readable storage medium may include, but are not limited to: electrical connections with one or more wires, portable computer disks, hard disks, random access memory (RAM), read-only memory (ROM), erasable Programming read-only memory (EPROM or flash memory), optical fiber, portable compact disk read-only memory (CD-ROM), optical storage device, magnetic storage device, or any suitable combination thereof. In the present disclosure, the computer-readable storage medium may be any tangible medium containing or storing a program, and the program may be used by or in combination with an instruction execution system, apparatus, or device. In the present disclosure, the computer-readable signal medium may include a data signal propagated in a baseband or propagated as a part of a carrier wave, in which a computer-readable program code is carried. Such propagated data signal may take many forms, including but not limited to electromagnetic signals, optical signals, or any suitable combination of the foregoing. The computer-readable signal medium may also be any computer-readable medium other than the computer-readable storage medium, and the computer-readable medium may send, propagate, or transmit a program for use by or in connection with an instruction execution system, apparatus, or device. The program code contained in the computer-readable medium may be transmitted using any appropriate medium, including but not limited to wireless, wireline, optical fiber cable, RF, etc., or any suitable combination of the foregoing.

The flowchart and block diagrams in the drawings illustrate the architecture, functionality, and operation of possible implementations of systems, methods and computer program products according to various embodiments of the present disclosure. In this regard, each block in the flowchart or block diagram may represent a module, a program segment, or a part of code, which contains one or more executable instructions used to implement the specified logic functions. It should also be noted that in some alternative implementations, the functions noted in the blocks may also occur in a different order than those marked in the drawings. For example, two successively represented boxes may actually be executed substantially in parallel, and they may sometimes be executed in the reverse order, depending on the functions involved. It should also be noted that each block in the block diagram or flowchart, and combinations of blocks in the block diagram or flowchart, can be implemented with a dedicated hardware-based system that performs the specified function or operation, or can be implemented with a combination of dedicated hardware and computer instructions.

The units described in the embodiments of the present disclosure may be implemented by software or hardware. The described units may also be provided in a processor. The names of these units do not, in some cases, define the units themselves.

As another aspect, the present application also provides a computer-readable medium, which may be included in the electronic device described in the foregoing embodiments; or may exist alone without being assembled into the electronic device. The computer-readable medium carries one or more programs, and when the one or more programs are executed by one of the electronic devices, the electronic device is enabled to implement the method for supplying a package as described in the above embodiments.

For example, the electronic device may implement the steps as shown in FIG. 1: step S110, recognizing information of a package on a conveyor belt; step S120, obtaining status information of a transport vehicle for delivering the package; step S130, based on the information of the package, the status information of the transport vehicle, and the status information of a robotic arm for grasping a package, determining a scheduling task for grasping and placing the package; step S140, scheduling the robotic arm based on the scheduling task to grasp the package and place it on a corresponding transport vehicle so that the transport vehicle transports the package.

It should be noted that although several modules or units of the device or apparatus for performing actions are mentioned in the detailed description above, this division is not mandatory. In fact, according to the embodiments of the present disclosure, the features and functions of the two or more modules or units described above may be embodied in one module or unit. Conversely, the features and functions of one module or unit described above can be further divided into multiple modules or units to be embodied.

Through the description of the above embodiments, those skilled in the art can easily understand that the exemplary embodiments described herein can be implemented by software, or by software in combination with necessary hardware. Therefore, the technical solutions according to the embodiments of the present disclosure may be embodied in the form of a software product, and the software product may be stored in a non-volatile storage medium (which may be a CD-ROM, a U disk, a mobile hard disk, etc.) or on a network, Including several instructions to enable a computing device (which may be a personal computer, a server, a touch terminal, or a network device, etc.) to execute the method according to the embodiments of the present disclosure.

Those skilled in the art will readily contemplate other embodiments of the present disclosure after considering the specification and practicing the contents disclosed herein. This application is intended to cover any modifications, uses or adaptations of the present disclosure. These modifications, uses, or adaptations follow the general principles of the present disclosure and include common general knowledge or conventional technical means in the technical field not disclosed by the present disclosure. The specification and embodiments are considered as exemplary only, and a true scope and spirit of the present disclosure are indicated by the appended claims.

It should be understood that the present disclosure is not limited to the precise structure that has been described above and shown in the drawings, and various modifications and changes can be made without departing from the scope thereof. The scope of the present disclosure is only limited by the appended claims.

What is claimed is:

1. A method for supplying a package, comprising:

recognizing information of a package on a conveyor belt;

obtaining status information of a transport vehicle for transporting the package;

determining a scheduling task for grasping and placing the package based on the information of the package, the status information of the transport vehicle, and status information of a robotic arm for grasping the package; and scheduling the robotic arm to grasp and place the package on a corresponding transport vehicle based on the scheduling task, so that the transport vehicle transports the package, wherein the determining the scheduling task for grasping and placing the package based on the information of the package, the status information of the transport vehicle, and the status information of the robotic arm for grasping the package comprises:

determining whether the package is a graspable package according to the information of the package; and when it is determined that the package is the graspable package, determining the scheduling task for grasping and placing the graspable package based on the status information of the transport vehicle and the status information of the robotic arm for grasping the package, wherein the determining the scheduling task for grasping and placing the graspable package based on the status information of the transport vehicle and the status information of the robotic arm for grasping the package comprises:

determining the scheduling task for grasping and placing the graspable package based on the status information of the transport vehicle and the status information of the robotic arm for grasping the package by using a time optimal allocation method.

2. The method for supplying a package according to claim 1, further comprising:

when it is determined that the package is not a graspable package, scheduling the robotic arm not to grasp the package.

3. The method for supplying a package according to claim 1, wherein the determining whether the package is the graspable package according to the information of the package comprises:

determining whether the package has an abnormality according to the information of the package, wherein the abnormality comprises one or more of the following: oversize, overheight, overweight, waybill not facing up, abnormal barcode, and abnormal package.

4. The method for supplying a package according to claim 1, wherein the recognizing the information of the package on the conveyor belt comprises:

recognizing at least one of the following information of the package by a camera: a package barcode, a package type, a package size, a package coordinate, and an orientation of a waybill on the package.

5. The method for supplying a package according to claim 4, wherein the recognizing the information of the package on the conveyor belt further comprises:

obtaining weight information of the package according to the information of the package recognized by the camera.

6. The method for supplying a package according to claim 5, wherein the obtaining the weight information of the package according to the information of the package recognized by the camera comprises:

sending the information of the package recognized by the camera to a designated system, and receiving the weight information of the package returned by the designated system.

7. The method for supplying a package according to claim 1, wherein the obtaining the status information of the transport vehicle for transporting the package comprises:

communicating with a system that manages the transport vehicle to obtain the status information of the transport vehicle for transporting the package.

8. The method for supplying a package according to claim 7, wherein after scheduling the robotic arm to grasp and place the package on the corresponding transport vehicle based on the scheduling task, sending information about completion of placing the package to the system that manages the transport vehicle, so that the system that manages the transport vehicle schedules the transport vehicle to transport the package.

9. The method for supplying a package according to claim 1, wherein the grasping the package by the robotic arm comprises:

dynamically rotating a gripper of the robotic arm to grasp the package according to the information of the package.

10. The method for supplying a package according to claim 1, wherein the recognizing the information of the package on the conveyor belt comprises:

recognizing the same batch of packages on the conveyor belt one or more times to obtain information of the batch of packages; or recognizing each package on the conveyor belt to obtain information of the package.

11. The method for supplying a package according to claim 1, further comprising:

scheduling a number of the robotic arm to be turned on according to a number of the packages.

12. An electronic device, comprising:

a processor; and a memory, wherein the memory is stored with computer-readable instructions, and when the computer-readable instructions are executed by the processor, the processor performs:

recognizing information of a package on a conveyor belt;

obtaining status information of a transport vehicle for transporting the package;

determining a scheduling task for grasping and placing the package based on the information of the package, the status information of the transport vehicle, and status information of a robotic arm for grasping the package; and scheduling the robotic arm to grasp and place the package on a corresponding transport vehicle based on the scheduling task, so that the transport vehicle transports the package, wherein the processor is further configured to perform:

determining whether the package is a graspable package according to the information of the package;

when it is determined that the package is the graspable package, determining the scheduling task for grasping and placing the graspable package based on the status information of the transport vehicle and the status information of the robotic arm for grasping the package; and determining the scheduling task for grasping and placing the graspable package based on the status information of the transport vehicle and the status information of the robotic arm for grasping the package by using a time optimal allocation method.

13. The electronic device according to claim 12, wherein the processor is further configured to perform:

when it is determined that the package is not a graspable package, scheduling the robotic arm not to grasp the package.

14. The electronic device according to claim 12, wherein the processor is further configured to perform:

determining whether the package has an abnormality according to the information of the package, wherein the abnormality comprises one or more of the following: oversize, overheight, overweight, waybill not facing up, abnormal barcode, and abnormal package.

15. The electronic device according to claim 12, wherein the processor is further configured to perform:

recognizing at least one of the following information of the package by a camera: a package barcode, a package type, a package size, a package coordinate, and an orientation of a waybill on the package.

16. A computer-readable storage medium having stored thereon a computer program that, when executed by a processor, implements:

recognizing information of a package on a conveyor belt;

obtaining status information of a transport vehicle for transporting the package;

determining a scheduling task for grasping and placing the package based on the information of the package, the status information of the transport vehicle, and status information of a robotic arm for grasping the package; and scheduling the robotic arm to grasp and place the package on a corresponding transport vehicle based on the scheduling task, so that the transport vehicle transports the package, wherein the computer program further implements:

determining whether the package is a graspable package according to the information of the package;

when it is determined that the package is the graspable package, determining the scheduling task for grasping and placing the graspable package based on the status information of the transport vehicle and the status information of the robotic arm for grasping the package; and determining the scheduling task for grasping and placing the graspable package based on the status information of the transport vehicle and the status information of the robotic arm for grasping the package by using a time optimal allocation method.

* * * * *